US009924841B1

(12) United States Patent
Luquin

(10) Patent No.: US 9,924,841 B1
(45) Date of Patent: Mar. 27, 2018

(54) VENTILATED TOILET SEAT

(71) Applicant: Oscar Luquin, Belton, TX (US)

(72) Inventor: Oscar Luquin, Belton, TX (US)

( * ) Notice: Subject to any disclaimer, the term of this patent is extended or adjusted under 35 U.S.C. 154(b) by 267 days.

(21) Appl. No.: 14/842,261

(22) Filed: Sep. 1, 2015

(51) Int. Cl.
*A47K 13/30* (2006.01)
*E03D 9/00* (2006.01)
*E03D 9/052* (2006.01)

(52) U.S. Cl.
CPC ..... *A47K 13/307* (2013.01); *E03D 9/007* (2013.01); *E03D 9/052* (2013.01)

(58) Field of Classification Search
CPC ..... A47K 13/307; E03D 9/007; E03D 9/052
USPC ..... 4/217, 229
See application file for complete search history.

(56) References Cited

U.S. PATENT DOCUMENTS 3,659,296 A * 5/1972 Stamper ..... E03D 9/052 4/217
D355,959 S 2/1995 Kaiser
6,622,315 B1 * 9/2003 Feygin ..... E03D 9/005 4/229
7,614,092 B1 11/2009 Turkman
7,730,560 B2 6/2010 Markaj
2007/0186334 A1 8/2007 Carter
2008/0040842 A1 2/2008 Sanabria
2008/0256692 A1 * 10/2008 Barton ..... A47K 13/307 4/217
2011/0191950 A1 8/2011 Liu
2013/0205484 A1 8/2013 Taciuc
2013/0283512 A1 10/2013 Florexil

FOREIGN PATENT DOCUMENTS

DE 102005036152 11/2012

* cited by examiner

*Primary Examiner* — Tuan T Nguyen
(74) *Attorney, Agent, or Firm* — Kyle A. Fletcher, Esq.

(57) ABSTRACT

The ventilated toilet seat is a toilet seat adapted for use with a toilet bowl. The ventilated toilet seat is further defined with a top surface, a bottom surface, and a peripheral surface. The toilet seat includes a fragrance dispensing system, and an odorous extraction system. Both the fragrance dispensing system and the odorous extraction system are in wired connection with a powering member that is also integrated into the toilet seat. A pressure sensor on the top surface of the toilet seat is adapted to detect an end user, and commence operation of the fragrance dispensing system and the odorous extraction system. The odorous extraction system includes a pair of extractor registers on the bottom surface of the toilet seat.

7 Claims, 4 Drawing Sheets

VENTILATED TOILET SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilet seats, more specifically, a toilet seat that is able to dispense a fragrance as well as to extract and filter odorous air.

The device of the present application overcomes shortfalls of the prior art by introducing a toilet seat that is able to extract odorous air as well as dispense a fragrance.

SUMMARY OF INVENTION

The ventilated toilet seat is a toilet seat adapted for use with a toilet bowl. The ventilated toilet seat is further defined with a top surface, a bottom surface, and a peripheral surface. The toilet seat includes a fragrance dispensing system, and an odorous extraction system. Both the fragrance dispensing system and the odorous extraction system are in wired connection with a powering member that is also integrated into the toilet seat. A pressure sensor on the top surface of the toilet seat is adapted to detect an end user, and commence operation of the fragrance dispensing system and the odorous extraction system. The odorous extraction system includes a pair of extractor registers on the bottom surface of the toilet seat. The pair of extractor registers draw in odorous outside air, and direct said odorous outside air across a filter that removes odor there from, and directs filtered air across a fan before exiting along a rear side of the toilet seat. The fragrance nozzle dispenses a fragrance that is atomized, and directed aside of the toilet seat. Both the filtered air and the fragrance nozzle are provided on the peripheral surface.

It is an object of the invention to provide a toilet seat that is able to extract odorous outside air, and filter said air before re-introduction to the outside.

It is a further object of the invention to provide a toilet seat that is able to dispense a fragrance.

It is an even further object of the invention to provide a toilet seat that is able to filter odorous outside air in concert with dispensing a fragrance.

These together with additional objects, features and advantages of the ventilated toilet seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the ventilated toilet seat in detail, it is to be understood that the ventilated toilet seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ventilated toilet seat.

It is therefore important that the claims be regarded as including such equivalent construction insofar as they do not depart from the spirit and scope of the ventilated toilet seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
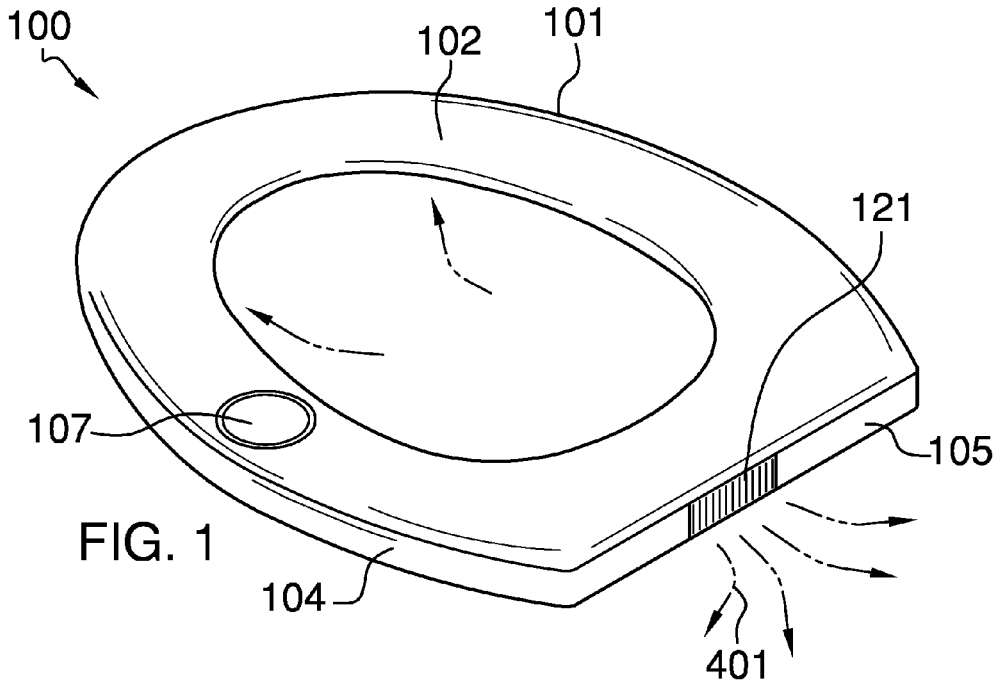
FIG. 1 is a perspective view of an embodiment of the disclosure.
Figure 2:
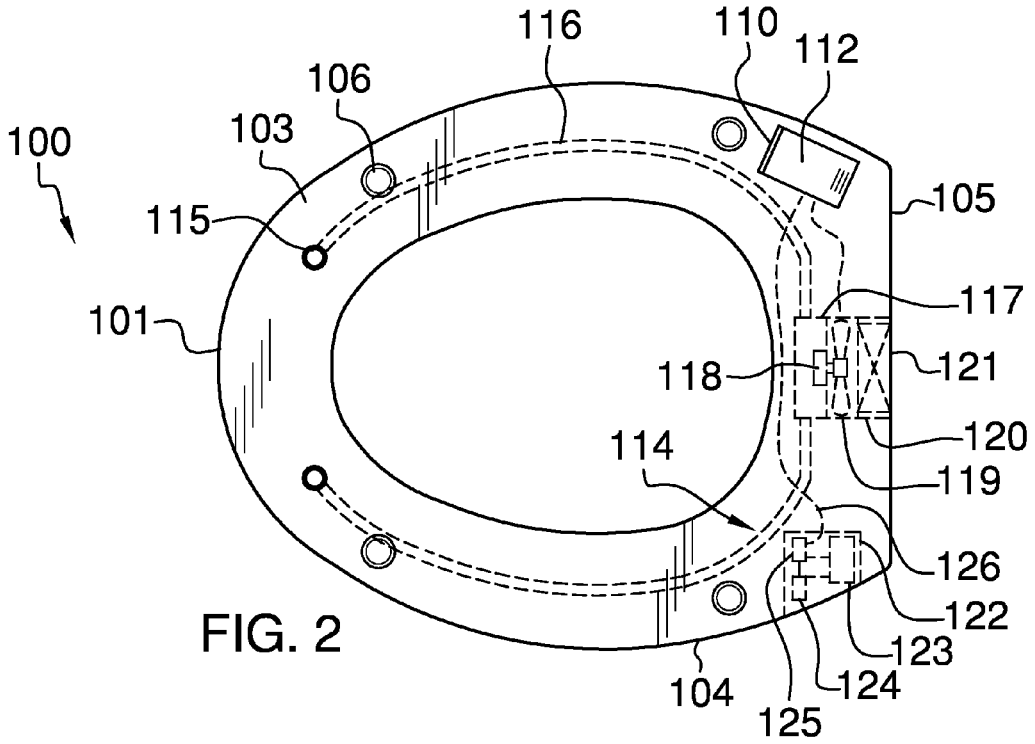
FIG. 2 is a bottom view of an embodiment of the disclosure.
Figure 3:
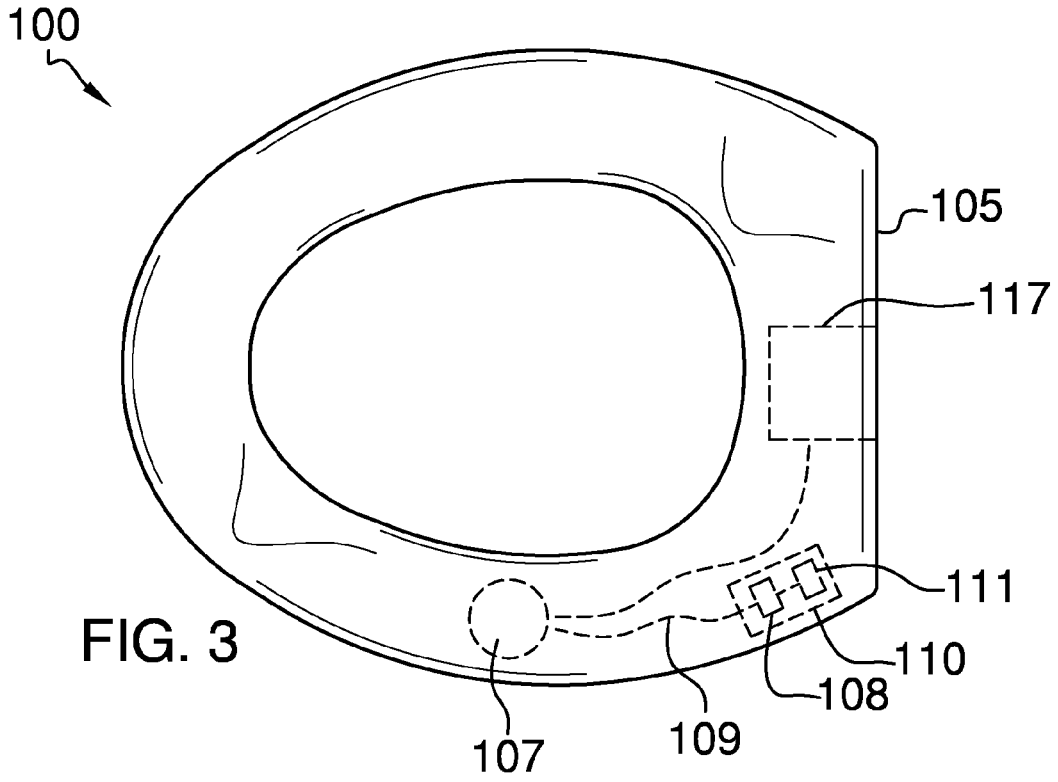
FIG. 3 is a top view of an embodiment of the disclosure.
Figure 4:
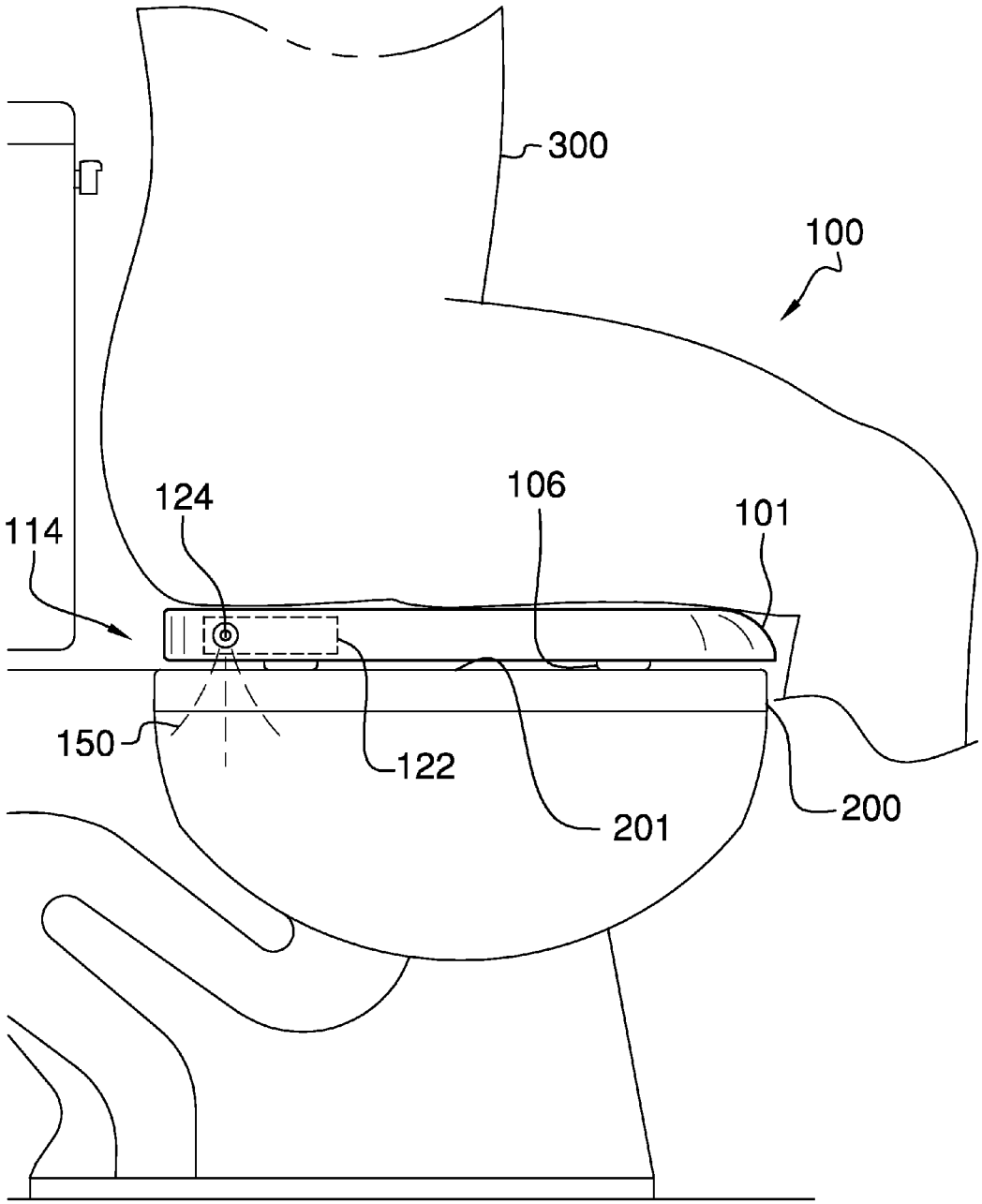
FIG. 4 is a side view of an embodiment of the disclosure.
Figure 5:
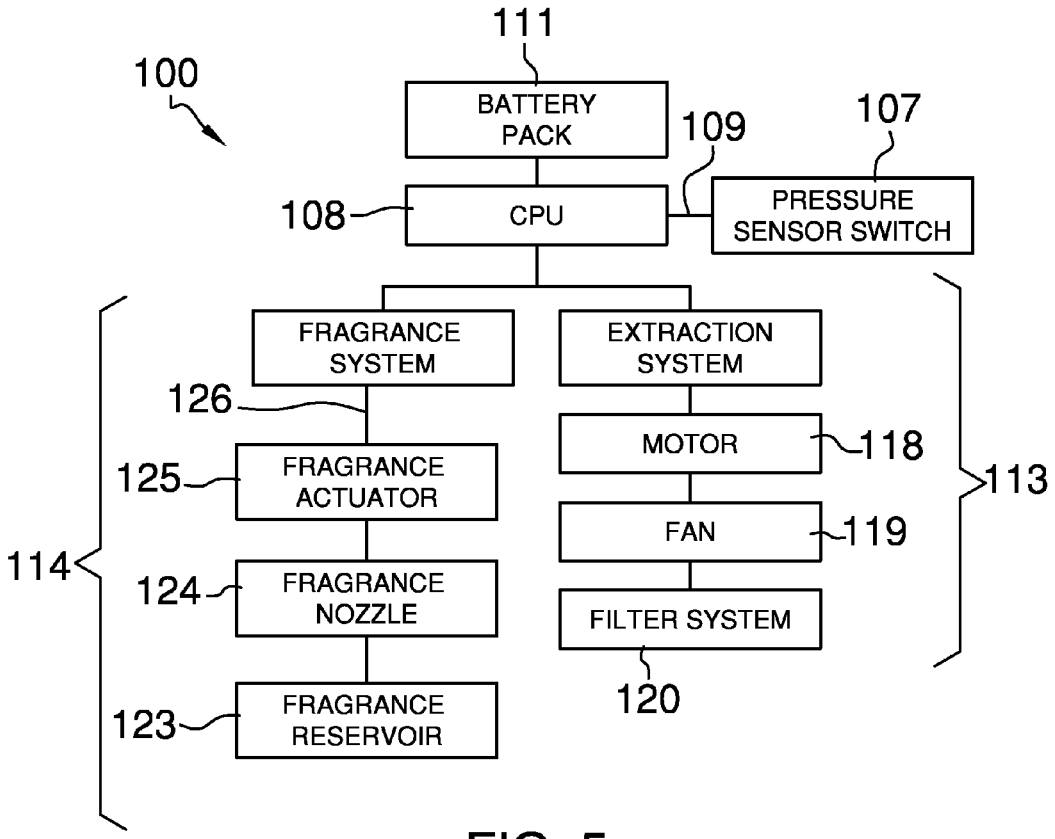
FIG. 5 is a block diagram of an embodiment of the disclosure.

Detailed reference will now be made to a first potential embodiment of the disclosure, which is illustrated in FIGS. 1 through 5. The ventilated toilet seat 100 (hereinafter invention) comprises a toilet seat 101 that is adapted for use with a toilet bowl 200. The toilet seat 101 is further defined with a top surface 102, a bottom surface 103, a peripheral surface 104, and a rear side 105. The bottom surface 103 includes toilet seat legs 106 that are adapted to engage a top bowl surface 201 of the toilet bowl 200, which is well known in the art.

The invention 100 includes a pressure sensor 107 on the top surface 102. The pressure sensor 107 is essentially an on/off switch that controls the overall functionality of the invention 100. The pressure sensor 107 is adapted to detect an end user 300 on the toilet seat 101. The pressure sensor 107 is connected with a central processing unit 108 via a sensor wire 109. The sensor wire 109 extends inside of the toilet seat 101 from the pressure sensor 107 to a battery compartment 110.

The battery compartment 110 is located on the bottom surface 103 of the toilet seat 101. The battery compartment 110 houses at least one battery 111, which provides electrical needs for the invention 100. Moreover, the battery compartment 100 includes a compartment door 112 that opens to reveal the battery compartment 110. The at least one battery 111 is wired to the central processing unit 108. The central processing unit 108 is referred to as CPU in FIG. 5, and is responsible for operation of an odorous extraction system 113 and a fragrance dispensing system 114.

The odorous extraction system 113 is integrated into the construction of the toilet seat 101. The odorous extraction system 113 includes at least one extractor register 115 that is integrated into the bottom surface 103 of the toilet seat 101. The at least one extractor register 115 is connected to an extractor conduit 116 that extends along an interior of the toilet seat 101, and over to a fan cavity 117. The fan cavity 117 is located adjacent to the rear side 105 of the toilet seat 101. The fan cavity 117 houses a motor 118, a fan 119, and a filter 120.

The motor 118 is in mechanical connection with the fan 119, which is responsible for producing a vacuum that draws air into the at least one extractor register 115. Moreover, the fan 119 creates a vacuum that draws in odorous outside air 400, which is channeled down the extractor conduit 116. The fan 119 draws the odorous outside air 400 into the fan cavity 117, across the fan 119 itself, across the filter 120. Once the odorous outside air 400 passes across the filter 120, air 401 is expelled from a vent 121 out of the fan cavity 117 of the toilet seat 101.

The fragrance dispensing system 114 is integrated into the construction of the toilet seat 101. The fragrance dispensing system 114 includes a fragrance cavity 122 that is built into the toilet seat 101. The fragrance cavity 122 houses a fragrance reservoir 123 that is in fluid connection with a fragrance nozzle 124. The fragrance nozzle 124 is connected to a fragrance actuator 125. The fragrance actuator 125 is connected to the central processing unit 108 via a fragrance wire 126. The fragrance reservoir 123 stores an undefined volume of fragrance 150 that is dispensed via the fragrance nozzle 124. The fragrance nozzle 124 dispenses the fragrance 150 in an atomized spray, which mixes with air.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ventilated toilet seat comprising:

a toilet seat that includes a fragrance dispensing system that is able to dispense a fragrance;

wherein the toilet seat includes an odorous extraction system that is adapted to extract and filter an odorous air;

wherein the toilet seat is adapted for use with a toilet bowl;

wherein the toilet seat is further defined with a top surface, a bottom surface, a peripheral surface, and a rear side;

wherein the bottom surface includes toilet seat legs that are adapted to engage a top bowl surface of the toilet bowl;

wherein the toilet seat includes a pressure sensor on the top surface;

wherein the pressure sensor is adapted to detect an end user on the toilet seat;

wherein the pressure sensor is connected with a central processing unit via a sensor wire;

wherein the sensor wire extends inside of the toilet seat from the pressure sensor to a battery compartment;

wherein the battery compartment is located on the bottom surface of the toilet seat;

wherein the battery compartment houses at least one battery;

wherein the battery compartment includes a compartment door that opens to reveal the battery compartment;

wherein the at least one battery is wired to the central processing unit;

wherein the central processing unit is responsible for operation of the odorous extraction system and the fragrance dispensing system;

wherein the odorous extraction system is integrated into the construction of the toilet seat;

wherein the odorous extraction system includes at least one extractor register that is integrated into the bottom surface of the toilet seat;

wherein the at least one extractor register is connected to an extractor conduit that extends along an interior of the toilet seat, and over to a fan cavity;

wherein the fan cavity is located adjacent to the rear side of the toilet seat;

wherein the fan cavity houses a motor, a fan, and a filter wherein the motor is in mechanical connection with the fan, which is responsible for producing a vacuum that draws air into the at least one extractor register;

wherein the fan creates a vacuum that draws in odorous outside air, which is channeled down the extractor conduit.

2. The ventilated toilet seat according to claim 1 wherein the fan draws the odorous outside air into the fan cavity, across the fan itself, across the filter.

3. The ventilated toilet seat according to claim 2 wherein the odorous outside air passes across the filter, and becomes air that is expelled from a vent out of the fan cavity of the toilet seat.

4. The ventilated toilet seat according to claim 3 wherein the fragrance dispensing system is integrated into the construction of the toilet seat; wherein the fragrance dispensing system includes a fragrance cavity that is built into the toilet seat.

5. The ventilated toilet seat according to claim 4 wherein the fragrance cavity houses a fragrance reservoir that is in fluid connection with a fragrance nozzle.

6. The ventilated toilet seat according to claim 5 wherein the fragrance nozzle is connected to a fragrance actuator; wherein the fragrance actuator is connected to the central processing unit via a fragrance wire.

7. The ventilated toilet seat according to claim 6 wherein the fragrance reservoir stores an undefined volume of fragrance that is dispensed via the fragrance nozzle; wherein the fragrance nozzle dispenses the fragrance in an atomized spray, which mixes with air.

* * * * *